US006273756B1

(12) United States Patent
Ward et al.

(10) Patent No.: US 6,273,756 B1
(45) Date of Patent: Aug. 14, 2001

(54) CHASSIS POWER CONNECTOR WITH COAXIAL SHIELDING

(75) Inventors: Terence G. Ward, Redondo Beach; Scott D. Downer, Torrance, both of CA (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/419,645

(22) Filed: Oct. 18, 1999

(51) Int. Cl.[7] ..... H01R 13/648
(52) U.S. Cl. ..... 439/607; 439/372; 439/533
(58) Field of Search ..... 439/372, 153, 439/157, 160, 533, 607, 289, 608, 609

(56) References Cited

U.S. PATENT DOCUMENTS 3,020,516 * 2/1962 Despard ..... 439/533
4,678,260 * 7/1987 Gallusser et al. ..... 439/607
4,695,110 * 9/1987 Wasserlein ..... 439/289
4,840,574 * 6/1989 Mills ..... 439/372
4,990,094 * 2/1991 Chandler et al. ..... 439/607
5,507,664 * 4/1996 Carmo ..... 439/372
5,551,885 * 9/1996 Yamanashi et al. ..... 439/372

FOREIGN PATENT DOCUMENTS

0667957 * 11/1938 (DE) ..... 439/350

* cited by examiner

*Primary Examiner*—Hien Vu
(74) *Attorney, Agent, or Firm*—Christopher DeVries

(57) ABSTRACT

A chassis cast power connector with coaxial shielding is presented according to the present invention. In an exemplary embodiment, the chassis cast power connector comprises a connector receptacle which is integrally cast with a chassis and extends away from one surface of the chassis. The connector receptacle includes an opening which receives male and female connector members, wherein the male connector member is capable of being slidably received in the female connector receptacle to form an electrical connection therebetween. The integral connector receptacle provides coaxial shielding of the electrical connection.

16 Claims, 1 Drawing Sheet

CHASSIS POWER CONNECTOR WITH COAXIAL SHIELDING

TECHNICAL FIELD

The present invention relates generally to electrical connectors. More particularly, the present invention relates to a chassis cast power connector with coaxial shielding.

BACKGROUND OF THE INVENTION

With the continuing increase in the supply and demand for powering various electrical devices which are used extensively in an apparatus, such as a motor vehicle, the need for improved high power connectors exists. Motor vehicles of today have numerous electrical components and electrical motors which require power to run. As a result, power is distributed along the motor vehicle by power carriers, e.g., power cables, and power connectors, e.g., bus bars, which are used to connect the various electrical devices to a power source, a motor, or the like of the vehicle. Consequently, high power connectors which are used in the automotive field and elsewhere must be capable of withstanding high current loads. Typically, the power connectors includes a female connector member and a male connector member for sliding insertion into the female connector member. The female connector member in turn is connected to a cable assembly and the male connector member may be connected to a second cable assembly. By joining the male and female connector members together power may easily be distributed along the motor vehicle by use of these power connector members. Each of the connector members includes complementary power contacts and dielectric insulation disposed therein.

Conventionally, high power connectors were received in openings formed in the chassis and the connectors were mated to the chassis using a number of fasteners. One advantage of this mounting location in a typical automotive application is that the vehicle's chassis provides the low voltage circuitry return path. Typically, one of the male and female connector members is received in a power connector receptacle prior to the receptacle being secured to the chassis. The receptacle is generally plated with nickel before one of the connector members is inserted into the receptacle to form a receptacle assembly. This receptacle assembly is then mated to the chassis with fasteners. In an exemplary embodiment, the chassis is part of an electronic box in the motor vehicle. An interface gasket must be used between the chassis and connector receptacle to help seal the receptacle assembly for electromagnetic interference (EMI) and environmental contaminates. Furthermore, the environment in which these power connectors are used puts a great deal of both mechanical and thermal stress on the power connectors.

This conventional process requires that the high power receptacle be formed separately from the vehicle's chassis and because the receptacle is mounted to the chassis within an opening after the receptacle and connector member are joined, the process involves a series of steps involving separate components and increased time.

SUMMARY OF THE INVENTION

The present invention comprises a chassis cast power connector with coaxial shielding for preventing conductors within the connector from broadcasting electromagnetic interference (EMI) outside of the connector. In an exemplary embodiment, the chassis cast power connector comprises a connector receptacle which is cast with a chassis and extends away from one surface of the chassis. The connector receptacle includes an opening which preferably receives male and female connector members, wherein the male connector member is capable of being slidably received in the female connector receptacle to form an electrical connection therebetween.

The connector receptacle acts a shield for protecting the electrical connection formed between the mated male and female connector members. A locking member is preferably provided with the connector receptacle for releasably retaining one of the male and female connector members within the connector receptacle during the mating process with the other of the male and female connector members.

Because the connector receptacle is integral with the chassis, improved coaxial EMI containment and improved environmental seal are provided by the present invention. Additionally, these improvements are provided in a connector capable of handling high power loads, on the order of 60 kilowatts and higher. In addition, the present invention offers other advantages over conventional power connectors as will be discussed in greater detail hereinafter. For example, the integral nature of the connector receptacle permits greater weight cable assemblies or bus bar assemblies to be used therewith.

The above-described and other features and advantages of the present invention will be appreciated and understood by those skilled in the art from the following detailed description, drawings, and appended claims.

BRIEF DESCRIPTION OF THE DRAWINGS

The present invention will now be described by way of example with reference to the following Figures, in which.

DETAILED DESCRIPTION OF THE INVENTION

Figure 1:
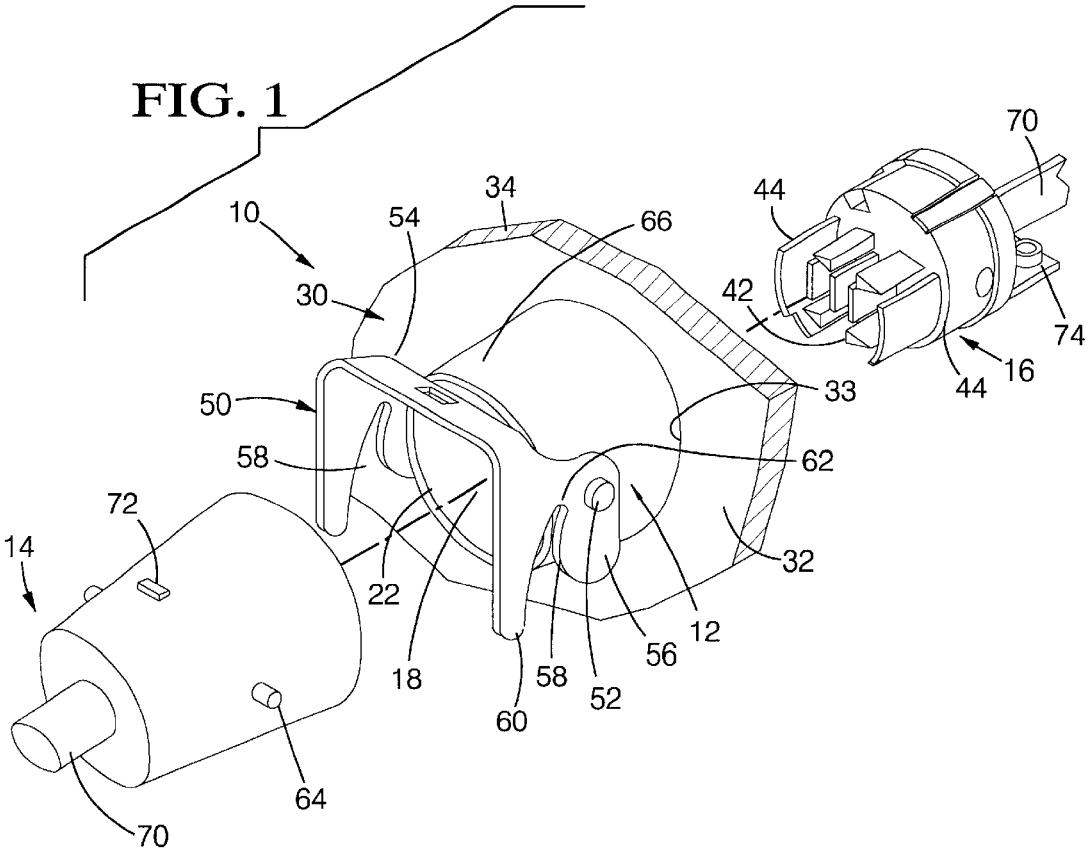
FIG. 1 is an exploded perspective view of a chassis cast power connector with coaxial shielding.
Figure 2:
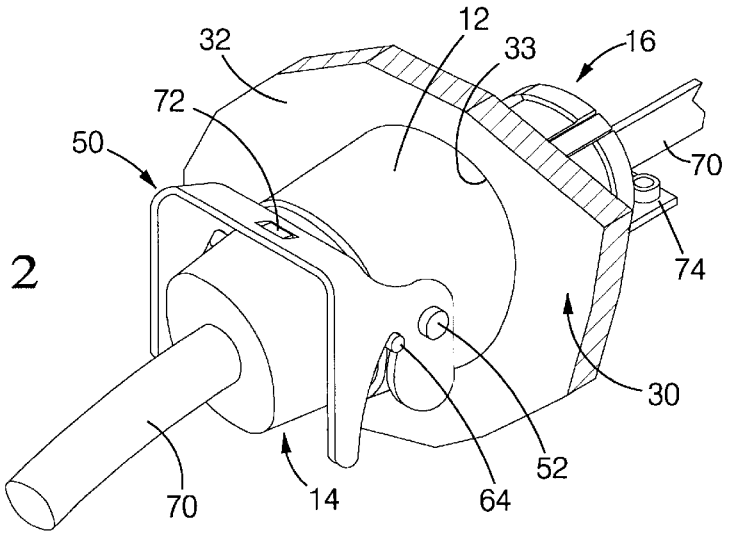
FIG. 2 is a perspective view of the chassis cast power connector with coaxial shielding in an assembled state.

Referring to FIGS. 1–2, a chassis cast power connector with coaxial shielding according to the present invention is generally designated by reference numeral 10. FIG. 1 is an exploded perspective view of chassis cast power connector 10. Chassis cast power connector 10 includes a connector receptacle 12 which is cast with a chassis 30 as a unitary piece, a first connector member 14, and a second connector member 16. In an exemplary embodiment, chassis 30 is a cast metal part of an electronic box (not shown). The chassis 30 may be cast from any suitable metal, with preferred examples being cast from aluminum, zinc or magnesium. The chassis 30 and first connector member 14 comprises a female connector member and second connector member 16 comprises a male connector member which is capable of being slidably received in female connector member 14. It being understood that it is within the scope of the present invention that first connector member 14 may comprise the male connector member and second connector member 16 may comprise the female connector member. However, for the purpose of illustration only, first connector member 14 will be described herein as being the female connector member and second connector member 16 as being the male connector member. Because connector receptacle 12 is cast with chassis 30, connector receptacle 12 is an integral part of chassis 30. Chassis 30 includes a first surface 32 and an opposing second surface 34. Chassis 30 further includes an opening 33. Opening 33 is sized to receive second connector member 16 in the exemplary embodiment illustrated in the Figures.

Connector receptacle 12 comprises a member which is intended to receive male connector member 16 which extends through opening 33 formed in chassis 30. Connector receptacle 12 extends away from first surface 32 of chassis 30 and includes a central opening 18 which is axially aligned with the opening formed in chassis 30 so that second connector member 16 is capable of extending through both of these openings. In the exemplary embodiment illustrated in FIGS. 1–2, connector receptacle 12 comprises a tube-like member having a first end 20 and an opposing second end 22, wherein the first end 20 is integral with first surface 32 and second end 22 extends away from first surface 32. At second end 22, connector receptacle 12 is intended to receive female connector member 14 which is designed to mate with male connector member 16 to form an electrical connection therebetween. Due to the integral nature of connector receptacle 12 and chassis 30, a coaxial integral interface results between these two members at first surface 32.

It being understood that connector receptacle 12 may take the form of a number of shapes and the dimensions of connector receptacle 12 are not critical so long as connector receptacle 12 is capable of receiving male connector member 16 at first end 20 and complementary female connector member 14 at second end 22. It is further understood that first and second connector members 14 and 16, respectively, may comprise a connector member commonly referred to as a hermaphroditic connector. Connector receptacle 12 acts as a shield to protect the electrical connection formed between female and male connector members 14 and 16, respectively, from electromagnetic interference (EMI) in the surrounding environment. Connector receptacle 12 is preferably of such a length that it surrounds at least a portion of male connector member 16 and at least a portion of female connector member 14 when the two are mated to one another.

Connector receptacle 12 further includes a locking member 50 which interlockingly and releasably retains female connector member 14 to male connector member 16 when the two are mated to one another. In an exemplary embodiment, locking member 50 comprises a latch locking mechanism which is rotatably coupled to connector receptacle 12 by a pair of pins 52. Latch locking member 50 rotates about pins 52 to permit female connector member 14 to gain access to connector receptacle 12 at second end 22. This rotation permits latch locking member 50 to engage and lock female connector member 14 in place within connector receptacle 12 when it is mated to male connector member 16.

Latch locking member 50 generally includes a support band 54 extending between a pair of ears 56. It being understood that in the exemplary embodiment, latch locking member 50 is a single integrally formed member. Each of ears 56 includes an arcuate slot 58 having an open end 60 and an opposite closed end 62, wherein closed end 62 of arcuate slot 58 is proximate pin 52 and open end 60 extends arcuately away from pin 52. Open end 60 of arcuate slot 58 permits female connector member 14 to be received therein so that an interlocking relationship is formed between latch locking member 50 and female connector member 14. In one embodiment, female connector member 14 interlocks with latch locking member 50 via engagement pins 64 provided on an outer surface of female connector member 14. More specifically, engagement pins 64 are received within open end 60 of arcuate slot 58 and as latch locking member 50 is rotated downward about pins 52, engagement pins 64 travel toward closed second end 62 of arcuate slot 58. Centrally located and formed within support band 54 is an opening 66 which may also serve as part of the locking mechanism by receiving an interlocking tab 72 extending from female connector member 14. It being understood that the locking or retention mechanism of the present invention is not limited to a latch locking member, such as latch 50, and other suitable retention mechanisms may be used to securely hold and retain female connector member 14 in a mating relationship with male connector member 16.

In one exemplary embodiment, male connector member 16 comprises any number of suitable power connector members which are conventionally used in power connector systems. Typically, male connector member 16 includes a plurality of contact blades 42 and a dielectric insulative body 44 which is generally in the form of a shell surrounding the plurality of contact blades 42. In the assembled state shown in FIG. 2, male connector member 16 is disposed within connector receptacle 12 and mates with complementary female connector member 14 to form the electrical connection therebetween. As shown in FIG. 2, female connector member 14 is connected at one end to a power carrying member 70, e.g., a power cable. It being understood that male connector member 16 preferably also includes power carrying member 70 extending therefrom. Power carrying member 70 may also comprise one end of a bus bar assembly (not shown). When power carrying member 70 comprises one end of the bus bar assembly, the one end may be coupled to either of female connector member 14 or male connector member 16 or there may be two separate bus bar assemblies, each of which is coupled to one of female connector member 14 and male connector member 16.

FIG. 2 is a perspective view of male connector member 16 disposed within connector receptacle 12 of the present invention. More specifically, male connector member 16 extends through the opening formed in chassis 30 and central opening 18 of connector receptacle 12 at first end 20. In the assembled state shown in FIG. 2, male connector member 16 and female connector member 14 are surrounded by connector receptacle 12 which acts as a shield. Male connector member 16 is secured within connector receptacle 12 by known methods which include clips 80 provided on male connector member 16 to secure male connector member 16 to chassis 30. Preferably, clips 80 comprise plastic clips.

As shown in FIG. 1, male connector member 16 optionally includes a bus bar termination tab 74 which extends rearwardly from male connector member 16. Bus bar termination tab 74 includes an opening 75 to receive a fastener (not shown) for coupling one end of the bus bar assembly (not shown) to bus bar termination tab 74. It being understood that female connector member 14 may also include a bus bar termination tab 74 so that female connector member 14 may be coupled to one end of a bus bar assembly.

Connector receptacle 12 is formed of the same material as chassis 30 due to it being integrally formed therewith. As is known, chassis 30 is generally formed of a metal material; however, any suitable EMI attenuating material may be used to form chassis cast power connector 10 of the present invention. In accordance with the present invention, chassis cast power connector 10 including connector receptacle 12 integral with chassis 30 is formed by a known casting process so that a single unitary piece is formed. In one exemplary embodiment, chassis 30 forms a part of an electronic box for use in a motor vehicle.

By integrally forming connector receptacle 12 as part of chassis 30, the present invention provides a power connector having improved coaxial EMI containment because of the improved relationship between connector receptacle 12 and chassis 30. As previously mentioned, the conventional interface between a conventional connector receptacle and chassis 30 required the use of a gasket and fasteners to mount a base plate of the connector receptacle to a surface of chassis 30. The gasket was interposed between chassis 30 and a connector receptacle flange. The present invention eliminates the need for the gasket and because the conventional connector receptacle and gasket forms an environmental and EMI seal, the present invention provides an improved seal by eliminating the gasket and butt joint fit between the connector receptacle and chassis 30. The improved seal results because connector receptacle 12 and chassis 30 are integrally joined eliminating the interface butt joint which provide a less effective seal.

Furthermore, the cast power connector 10 of the present invention is more cost effective than prior power connectors because it involves the use of fewer parts and several time consuming steps have been eliminated. For example, by not having an interface gasket and base mounting plate, the present invention does not require the use of fasteners which are typically used to mount the connector receptacle to chassis 30. By eliminating the process of mounting the connector receptacle to chassis 30, less labor and assembly time is needed to assembly chassis cast power connector 10.

The design of the present invention permits chassis cast power connector 10 to have an overall smaller volume when compared with the more conventional, multi-part, power connectors mated to chassis 30. Chassis cast power connector 10 is of improved quality due to its integral nature and the elimination of the use of several parts for assembly with chassis 30. In yet another aspect, the casting of connector receptacle 12 with chassis 30 improves the thermal properties of the chassis cast power connector 10 because any heat generated in the male/female electrical contact area can more easily be dissipated to chassis 30, which acts as a heat sink. Because connector receptacle 12 is integral to chassis 30, it forms only a portion of the surface of chassis 30 and thus the generated heat easily dissipates to the larger surface of chassis 30 resulting in a heat sink effect.

Furthermore, chassis cast power connector 10 of the present invention provides a structurally sound connector. The weight of a heavy cable assembly 70 is more evenly distributed from the connector receptacle 12 to chassis 30. Accordingly, this feature of the present invention permits more types of cable assemblies 70 or bus bar assemblies to be used with power connector 10 which comprises a solid, integral connector capable of supporting heavy cables or bus bar assemblies which couple to one or more of female and male connector members 14 and 16.

In one example, this invention provided a power connection for a 300 volt line having up to 200 Amperes of current. This example is not limiting, and the power connector can be used with both higher and lower power connections.

It will be understood that a person skilled in the art may make modifications to the preferred embodiments shown herein within the scope and intent of the claims. While the present invention has been described as carried out in specific embodiments thereof, it is not intended to be limited thereby but is intended to cover the invention broadly within the scope and spirit of the claims.

What is claimed is:

1. An electrical connector for use with a chassis, comprising:

a first connector member having a first contact therein;

a second connector member having a second contact therein, the second connector member being capable of being slidably received in the first connector member; and a connector receptacle integrally formed with the chassis as a unitary piece, thereby forming an environmental and EMI shield, the connector and chassis comprising a unitary piece of metal, the connector receptacle having an opening axially aligned with an opening formed within the chassis, the connector receiving first and second connector members at first and second ends thereof.

2. The electrical connector as set forth in claim 1, further comprising:

a latch locking member coupled to the connector receptacle, the latch locking member for releasably securing one of the first and second connector members to the connector receptacle.

3. The electrical connector as set forth in claim 2, wherein the connector receptacle includes an outer surface having a pair of opposing pins extending outwardly therefrom.

4. The electrical connector as set forth in claim 2, wherein the latch locking member includes a pair of slots for receiving and securing one of the first and second connector members to the connector receptacle.

5. The electrical connector as set forth in claim 4, wherein each of the slots comprises an arcuate slot having a closed end and an open end.

6. The electrical connector as set forth in claim 2, wherein the first connector member further includes a tab extending therefrom, the tab being received within a complementary opening formed in the latch locking member to thereby releasably interlock the first connector member to the latch locking member.

7. The electrical connector as set forth in claim 3, wherein the latch locking member is rotatably mounted to the outer surface of the connector receptacle about the opposing pins.

8. The electrical connector as set forth in claim 1, wherein the connector receptacle comprises a cylindrical tube.

9. The electrical connector as set forth in claim 1, wherein the chassis is part of an electrical box.

10. The electrical connector as set forth in claim 1, wherein the connector receptacle acts as an environmental and EMI seal.

11. The chassis as set forth in claim 1, wherein the connector receptacle outwardly extends away from an outer surface of the chassis.

12. A chassis including a power connector, comprising:

a connector receptacle integrally formed with the chassis as a unitary piece, thereby forming an environmental and EMI shield, the connector and chassis comprising a unitary piece of metal, the connector receptacle having an opening axially aligned with an opening formed within the chassis, the connector receptacle having an open first end for receiving a first connector member having a first contact therein, and an open second end for receiving a second connector member having a second contact therein, and a locking member coupled to the connector receptacle, the locking member for releasably securing one of the first and second connector members to the connector receptacle.

13. The chassis as set forth in claim 12, wherein the connector receptacle comprises a cylindrical tube, the connector receptacle acting as an environmental and EMI shield.

14. The chassis as set forth in claim 12, wherein the connector receptacle outwardly extends away from an outer surface of the chassis.

15. The chassis as set forth in claim 12, wherein the chassis is part of an electrical box.

16. An electrical connector for use with a vehicle chassis, comprising:

a first connector member having a first contact therein;

a second connector member having a second contact therein, the second connector member being capable of being slidably received in the first connector member;

a connector receptacle integrally formed with the vehicle chassis as a unitary piece, thereby forming an environmental and EMI shield, the connector and vehicle chassis comprising a unitary piece of metal, the connector receptacle having an opening axially aligned with an opening formed within the vehicle chassis, the connector receptacle receiving first and second connector members at first and second ends thereof; and wherein the connector receptacle is integrally formed to the vehicle chassis by casting.

* * * * *